United States Patent [19]

Schmidt

[11] Patent Number: 4,860,952

[45] Date of Patent: Aug. 29, 1989

[54] ELASTIC PLATE FOR LEVEL RAIL CROSSINGS

[75] Inventor: Peter Schmidt, Waldkraiburg, Fed. Rep. of Germany

[73] Assignee: Gummiwerke Kraiburg Elastik Beteiligungs GmbH & Co., Tittmoning, Fed. Rep. of Germany

[21] Appl. No.: 162,570

[22] Filed: Mar. 1, 1988

[30] Foreign Application Priority Data

Mar. 6, 1987 [DE] Fed. Rep. of Germany ..... 3707305

[51] Int. Cl.[4] ..... E01C 9/04

[52] U.S. Cl. ..... 238/8; 404/32

[58] Field of Search ..... 238/8, 2, 3, 5, 6, 9, 238/381, 379, 7, 10 F; 404/32, 33

[56] References Cited

U.S. PATENT DOCUMENTS

| | | | |
|---|---|---|---|
| 3,414,194 | 12/1968 | Seltzinger et al. | 238/10 F |
| 3,465,963 | 9/1969 | Caillet et al. | 238/8 |
| 3,843,051 | 10/1974 | Whitlock | 238/8 |
| 4,093,120 | 6/1978 | Canfield | 238/8 |
| 4,117,927 | 10/1978 | Whitlock | 238/8 |
| 4,236,670 | 12/1980 | Limmergard et al. | 238/8 |
| 4,289,273 | 9/1981 | Schmidt | 238/8 |
| 4,421,272 | 12/1983 | Whitlock | 238/8 |

*Primary Examiner*—Robert B. Reeves
*Assistant Examiner*—Joseph D. Pape
*Attorney, Agent, or Firm*—Mason, Kolehmainen, Rathburn & Wyss

[57] ABSTRACT

Elastic plates for level railroad crossings have rail-adjacent edges which are profiled in their vertical cross sections to provide the required interlock. The plates have a first pair of grooves in the top and the bottom of the plate running parallel to the rail and have a second pair of upper and lower parallel grooves in the top and the bottom of the plate running transverse to the rail. In each pair of grooves, the groove in the top of the plate is laterally offset with respect to a parallel groove in the bottom of the plate, and each pair of grooves forms an expansion and contraction crease therebetween. Pairs of grooves in the top and the bottom of the plate are spaced, so that the distances between individual expansion creases, or between expansion creases formed by groups of creases, are large relative to the distance between the grooves which constitute the expansion creases. The first and second pairs of grooves intersect one another and in order to prevent an aperture or opening from being formed in the plate at the points of intersection, an integral layer of material is provided at each intersection to seal between the upper and lower sides of the plates.

10 Claims, 3 Drawing Sheets

ELASTIC PLATE FOR LEVEL RAIL CROSSINGS

The invention relates to an elastic plate for level rail crossings, optionally positionable on a highway beyond the rails, extending from one rail to the next, or from a rail to the surface of the highway, the edges of the plate adjacent the rails being profiled in vertical cross section so as to provide the necessary interfit.

A variety of such plates are utilized to provide level rail crossings, because they are easy to maintain, and because they have the advantage of an extended useful life due to the material's resistance to atmospheric and industrial agents. The material of which the plates are made being elastically deformable, the plates may be positioned upon supporting surfaces so that stresses in the plate material do not persist.

Rail crossings which are traversed by heavy trucks require the use of relatively thick and heavy plates for building a level rail crossing. In application to rail crossings having light vehicular traffic or only pedestrian traffic, there is, by contrast, a tendency to use plates of lesser strength made of relatively hard elastic material. Due to savings in the material, such plates are more economical. Moreover, their transportation to the site, their installation and their removal from the site entail even fewer problems as compared to the thick and heavy plates which have been in use.

It has been recognized that plates of reduced total thickness must continue to rest evenly upon their supporting surfaces regardless of stresses caused by temperatures, weather conditions and loads, and that they must not arch or spuriously disengage from each other under stress.

It is consequently the object of the invention to provide plates which meet the requirements referred to above.

This object is achieved by providing the tops and bottoms of the plates with grooves running parallel and, if desired, angularly to the direction of the rails, the grooves in the top being laterally displaced with respect to the grooves in the bottom, groups of two or more adjacent, parallel and laterally displaced grooves opposing each other in the tops and bottoms of the plates constituting one or more resilient expansion crease, the grooves in the top and bottom of the plates being spaced so that the spacing between individual expansion creases, or the spacing between groups of creases constituted by a plurality of expansion creases is large relative to the spacing between the grooves constituting the expansion creases.

By providing the plates with one or more expansion creases which run longitudinally and parallel to the direction of the rails and, optionally, with additional expansion creases running at an angle to the rails, even plates made of relatively rigid and firm elastic material may be provided with portions which allow plastic deformation. The expansion creases of the invention function in the manner of the folds of a bellows and provide for a small, but adequate variability of the width of a plate which, by means of its profiled edges, is resiliently secured under the rail heads or anchored at the edge of the highway surface, such variability being in response to temperatures or stresses impinging upon the top surface of the plate without, however, causing the plate to be dislodged or arched as a unit. The same is true with respect to expansion in the direction longitudinal to the rails.

Adjoining edges of adjacent plates are also preferably profiled in their cross sections, the preferred profile being tongue and groove. By means of tongue and groove joints the adjacent plates interlock without gaps. To secure the plates against disengagement due to severe stresses, contiguous zones along adjacent edges of the plates are provided with recesses extending from the top of the plate and slanting toward the edge of the respective plate. Said recesses serve to receive the legs of a generally U-shaped bracket bridging two adjacent plates.

The means provided assure that expansion and contraction of the plates due to atmospheric conditions, temperatures and imposition of loads will be compensated for. Said means also guard against the risk of displacement of the plates with respect to one another due to momentary impacts or the like.

The capability of elastic expansion of the expansion creases is achieved by selecting groove depths so that the sum of the groove depths of opposed, parallel, laterally offset grooves exceeds the plate's total thickness.

In order to guard against reduced elasticity of the expansion creases which may result from clogged grooves it is desirable to select lesser depths for the grooves in the top of the plate than for the grooves in the bottom of the plate. Furthermore, a V-shaped configuration of the cross section of the groove is preferred to avoid pinching caused by rocks or the like invading the grooves. It will be understood that the grooves may be configurated differently.

As a result of the potential provision of expansion creases which are longitudinal and transverse to the length of the plate, the intersections of the grooves would exhibit gaps through the thickness of the plate transforming the plate into a perforate or grid plate. Such transformation is avoided by means of a molding tool which, during the process of manufacturing the plates, is suitable for plugging the apertures with a layer of material which is integral with the material of the plates.

Details of the invention are shown in the following description of its embodiments by reference to the drawings.

Figure 1:
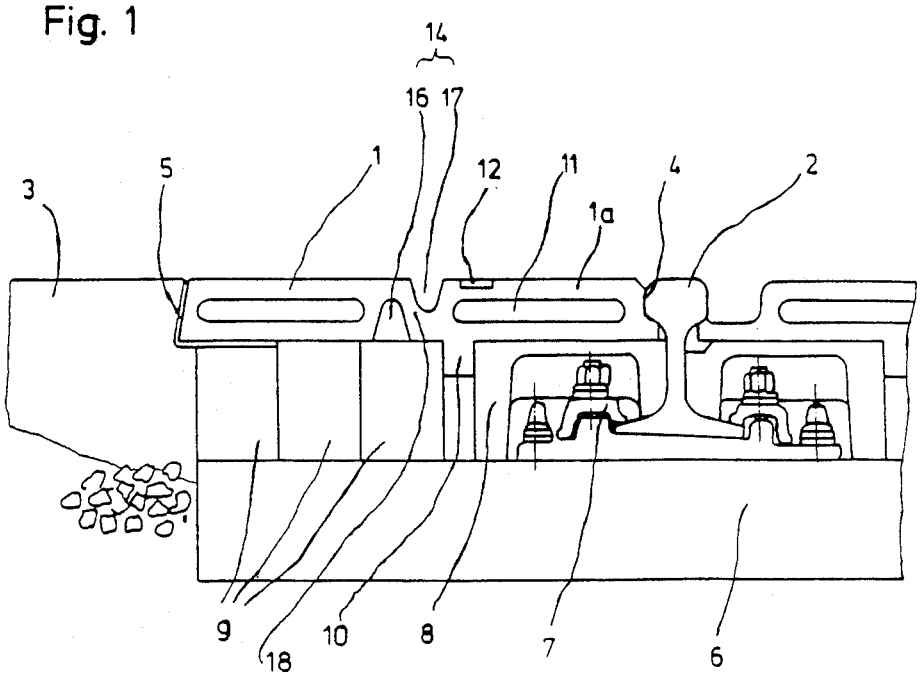
FIG. 1 shows a sectional view of a plate for level rail crossings having an expansion crease, the plate being installed between a rail and the adjacent highway surface.

A plate 1 made of relatively firm yet sufficiently elastic rubber material has a thickness of about 60 mm to 70 mm and serves as a level rail crossing between a rail 2 and the edge of the highway surface 3. The edges of plate 1 which run parallel to the rail have suitably profiled configurations interfitting respectively with rail head 4 and highway surface retainer 5. Rail 2 is secured in the customary manner on ties 6. The tie retainer 7 is capped by a shaped rail member 8. A plurality of wooden beams 9, positioned between highway surface retainer 5 and rail 2 spans a plurality of ties and provides support for plate 1. A projection 10 extends downwardly from the bottom surface of the plate, abuts shaped rail member 8 laterally and secures plate 1 against lateral displacement. Profiled tongues 11 are provided at the butt ends la of the plate parallel to the top of the plate and engage grooves in the adjoining plate which are not illustrated.

Figure 5:
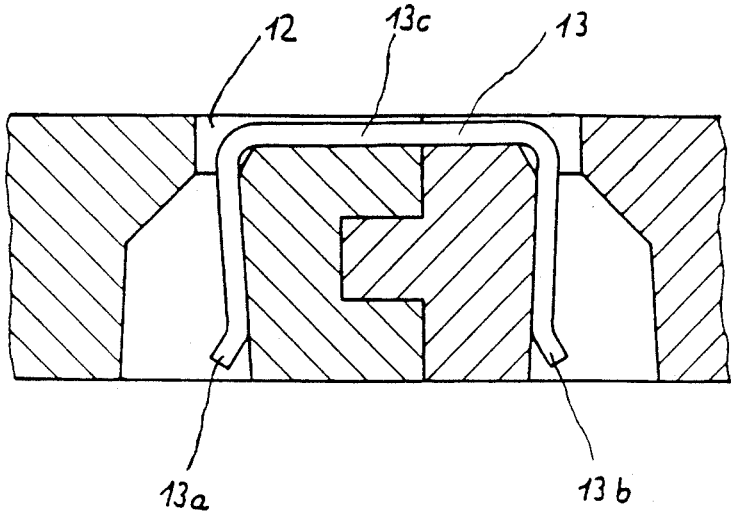
FIG. 5 shows a sectional view of a bracket joining adjacent plates.

A rectangular recess 12 in the top of plate 1 is shown in the sectional view illustrated by FIG. 1 and serves to receive a bracket 13 which, as shown in FIG. 5, secures adjoining plates and prevents separation of the plates. The bracket 13 is generally U-shaped. Its legs 13*a, b* are slightly slanted toward convergence with respect to its bridge member 13*c* and have diverging distal ends so as to anchor securely in plate 1. Bridge member 13C is received and countersunk in recess 12.

Plate 1 is provided with one expansion crease 14 extending longitudinally of the rail and with two transverse expansion creases 15. Each expansion crease, 14 or 15, is formed by two cooperating grooves 16 and 17. Groove 16 is provided in bottom of plate 1 in parallel with the longitudinal extension of the rail and is configurated as a V-shaped incision. For plates having an approximate total thickness of 60 to 70 mm, the maximum depth of the groove is about 40 mm.

Groove 17 is provided in the top of plate 1 and is also in parallel with the longitudinal extension of the rail and configurated as a V-shaped incision. Said groove, however, is laterally displaced with respect to groove 16 by 3.5 cm (spacing between the center lines of the grooves). The maximum depth of groove 17 is approximately 30 mm. In the embodiment shown, the lateral set-off between grooves 16 and 17 has been selected, so that proximate walls 16*a* and 17*a* of V-shaped grooves 16 and 17 parallel each other within a zone of approximately 10 mm and define a web 18 having a thickness of approximately 15 to 25 mm. In the embodiment illustrated, the thickness is 20 mm. The rubber material employed in the embodiment has a hardness of 90 Shore.

The above-specified dimensions of the expansion creases may be regarded as optimal for such material. It will be understood that web 18 is to be dimensioned by reference to the elastic properties of the rubber material composing the plate.

Expansion crease 14 serves to compensate for plastic deformations of plate 1 between shaped rail member 8 and highway surface retainer 5. Expansion creases 15, which run transverse to the direction of the rail, serve a corresponding function.

Figure 2:
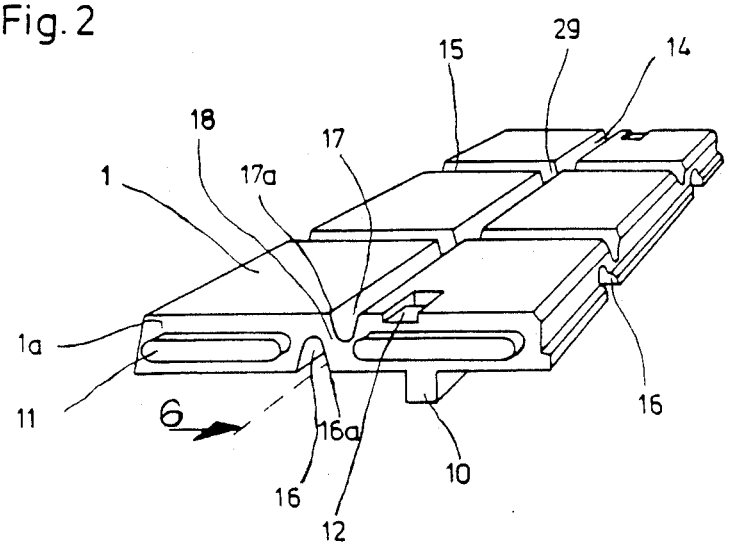
FIG. 2 is a perspective view of a plate shown in FIG. 1.
Figure 3:
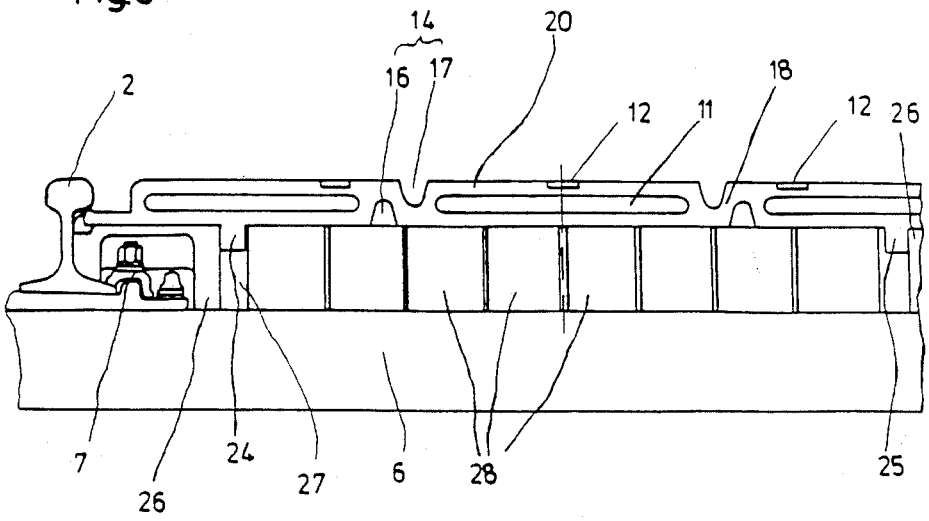
FIG. 3 shows a fragmental view of a plate having expansion creases and its associated foundation, the plate extending between two rails.
Figure 4:
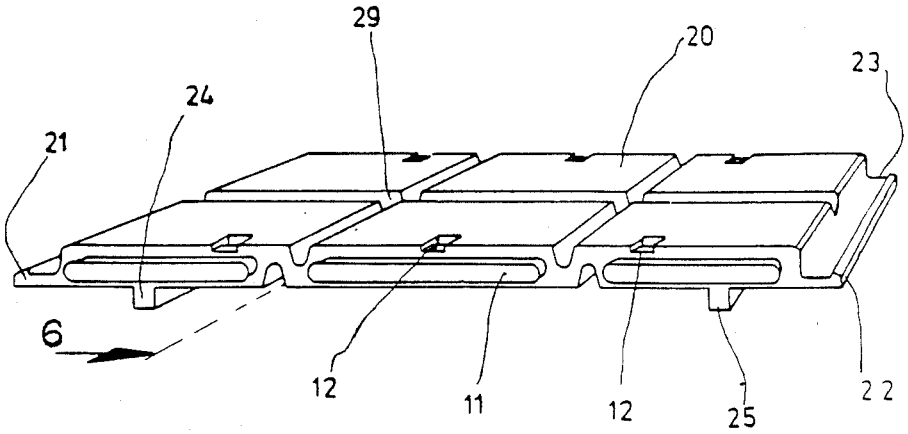
FIG. 4 is a perspective view of the plate shown in FIG. 3.

FIGS. 3 and 4 show a plate positioned between a pair of rails. The edges of the plate 20 adjacent to the rails abut the rail heads. Profiled edges 21 and 22 are proximate to the rail head and incorporate track groove 23. The foundation for plate 20 corresponds to the description set forth in conjunction with FIGS. 1 and 2. Projections 24 and 25 at the bottom of plate 20 abut shaped rail elements 26 and project into interstices 27 between shaped rail elements 26 and wooden blocks 28 which constitute the foundation and span a plurality of ties. In other respects, corresponding elements are identified by the same reference numerals as in FIGS. 1 and 2 so as to facilitate their association without additional description.

Figure 6:
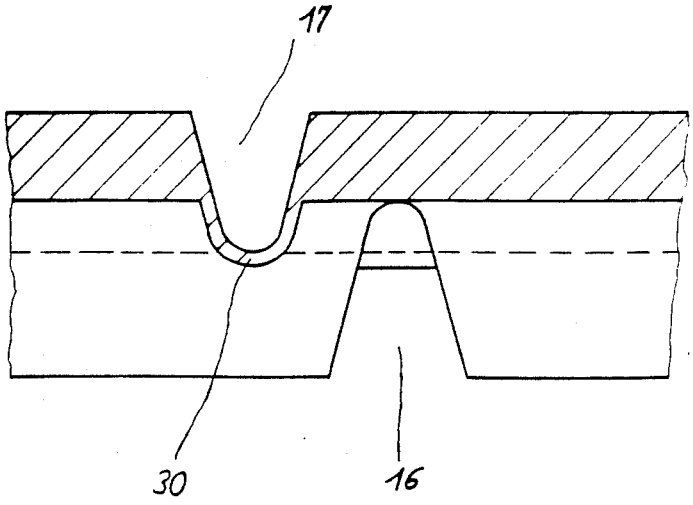
FIG. 6 shows a sectional view along line 6—6 of FIG. 4.

FIG. 6 shows a fragmented section along line 6—6 of FIG. 4 and illustrates the configuration of intersection 29 formed by expansion crease 14 and expansion crease 15, and particularly illustrates that the resulting aperture is sealed by a layer of material 30. Said layer of material is formed integrally with the remainder of the plate material at intersections 29 of expansion creases 14 and 15 and results from a suitable configuration of the mold.

I claim:

1. An elastic plate for supporting highway traffic at a railroad crossing at the level of the rails:

said plate having at least a first pair of upper and lower parallel grooves formed in respective upper and lower surfaces of said plate, said first grooves extending parallel of said rail and offset laterally from one another in a direction transverse to said rail forming a first expansion and contraction crease running parallel of said rail; and said plate having at least a second pair of upper and lower parallel grooves formed in respective upper and lower surfaces of said plates said second grooves extending transversely to intersect said first grooves and offset laterally from one another in a direction parallel of said rail to provide a second expansion and contraction crease running transversely of and intersecting said first crease.

2. The elastic plate of claim 1, wherein:

the depth of said upper groove added to the depth of said lower groove of said first pair is greater than the thickness of said plate between said upper and lower surfaces.

3. The elastic plate of claim 1, wherein:

the depth of said upper groove added to the depth of said lower groove of said second pair is greater than the thickness of said plate between said upper and lower surfaces.

4. The elastic plate of claim 1, wherein:

the depth of said first, upper groove is substantially equal to that of said second upper groove.

5. The elastic plate of claim 1, wherein:

the depth of an upper groove added to the depth of a lower groove in both said first pair and in said second pair is equal or greater than the thickness of said plate between said upper and lower surfaces; and including an integrally formed layer of material at intersections of each upper groove and a lower groove intersecting transverse thereto forming a web for preventing an aperture from otherwise being present in said plate between said upper and lower surfaces at said intersections.

6. The elastic plate of claim 5, wherein:

said thickness of said plate is about 60 to 70 mm, said upper grooves have a depth of approximately 30 mm and said lower grooves have a depth of approximately 40 mm.

7. The elastic plate of claim 26, wherein:

said elastic plate has a Shore hardness of approximately 90.

8. The elastic plate of claim 6, wherein:

said expansion and contraction creases comprise a web formed between surfaces of an upper groove and lower groove of each pair.

9. The elastic plate of claim 8, wherein:

said web has a thickness of approximately 15 to 25 mm.

10. The elastic plate of claim 1, in combination with a railroad track having elongated rails supported from a plurality of cross ties, each of said rails having an enlarged rail head, a vertical rail web and a rail base extending outwardly of rail web above said cross ties, said combination further including an inverted channel member having an inside leg resting on said rail base, a bight portion supporting said lower surface of said plate and an outside leg resting on said rail base, one or more beams parallel of said rail web resting on and spanning a plurality of said cross ties and spaced from said outside leg to form an interstice parallel of said rail, and an integrally formed key projection depending from said bottom surface of said plate in parallel with said rail, said projection extending into said interstice engaging said outer leg and said beam for securing said plate against lateral displacement.

* * * * *